US007225794B2

(12) United States Patent
Tanabe et al.

(10) Patent No.: US 7,225,794 B2
(45) Date of Patent: Jun. 5, 2007

(54) COMMON RAIL FUEL INJECTION SYSTEM

(75) Inventors: Keiki Tanabe, Tokyo (JP); Shinji Nakayama, Tokyo (JP); Susumu Kohketsu, Tokyo (JP)

(73) Assignee: Mitsubishi Fuso Truck and Bus Corporation (JP)

( * ) Notice: Subject to any disclaimer, the term of this patent is extended or adjusted under 35 U.S.C. 154(b) by 22 days.

(21) Appl. No.: 11/269,517

(22) Filed: Nov. 8, 2005

(65) Prior Publication Data

US 2006/0118090 A1 Jun. 8, 2006

(30) Foreign Application Priority Data

Nov. 8, 2004 (JP) ..... 2004-323964

(51) Int. Cl.
*F02M 37/04* (2006.01)

(52) U.S. Cl. ..... 123/456; 123/446; 123/496

(58) Field of Classification Search ..... 123/446, 123/447, 456, 510, 511, 496
See application file for complete search history.

(56) References Cited

U.S. PATENT DOCUMENTS 4,142,497 A * 3/1979 Long ..... 123/456
5,355,856 A * 10/1994 Paul et al. ..... 123/446
5,622,152 A * 4/1997 Ishida ..... 123/446
6,637,408 B2 * 10/2003 Djordjevic ..... 123/456
6,776,138 B2 * 8/2004 Mahr et al. ..... 123/446
6,786,205 B2 * 9/2004 Stuhldreher et al. ..... 123/495
6,904,893 B2 * 6/2005 Hotta et al. ..... 123/447
6,938,610 B2 * 9/2005 Braun et al. ..... 123/446

FOREIGN PATENT DOCUMENTS

JP 2002-364484 A 12/2002

* cited by examiner

*Primary Examiner*—Thomas Moulis
(74) *Attorney, Agent, or Firm*—Rossi, Kimms & McDowell LLP

(57) ABSTRACT

Immediately before fuel pressure is increased by a pressure-increase mechanism, a pressure-increase control valve of each cylinder is opened in timing that does not overlap the timing of opening of an injection control valve, and the period of time for which the pressure-increase control valves is opened is gradually increased. As a result, it is possible to prevent the quantity of fuel consumed by the pressure-increase mechanism from rapidly increasing when the increase of fuel pressure is started.

5 Claims, 10 Drawing Sheets

COMMON RAIL FUEL INJECTION SYSTEM

BACKGROUND OF THE INVENTION

1. Field of the Invention

The present invention relates to a common rail fuel injection system. In particular, the present invention relates to a common rail fuel injection system of a pressure-increase type in that a pressure-increase mechanism increases the pressure of high-pressure fuel supplied from a common rail.

2. Description of the Related Art

A common rail fuel injection system that accumulates high-pressure fuel that is pressure-fed from a supply pump and injects the fuel into cylinders of an engine through fuel injection valves in predetermined timing depending on the operating state of the engine has been put into practical use. This type of fuel injection system is becoming mainstream in the field of diesel engines for a vehicle because it is capable of controlling injection pressure and injection timing independently of each other, but there is still room for improvement in terms of NOx reduction and combustion noise reduction because, for example, the initial injection quantity is large due to injection pressure waveforms being substantially rectangular.

Therefore, a common rail fuel injection system of a pressure-increase type that is capable of controlling injection pressure waveforms has been developed as disclosed in, for example, Unexamined Japanese Patent Publication No. 2002-364484 (hereinafter referred to as Patent Publication 1). This type of fuel injection system is configured such that the pressure of fuel supplied from a common rail is increased by a pressure-increase mechanism, so that injection pressure waveforms of fuel can be controlled by arbitrarily setting whether or not pressure is to be increased by the pressure-increase mechanism and the timing of operation of the pressure-increase mechanism. The pressure-increase mechanism increases fuel pressure by a pressure-increase piston, and the elimination of fuel pressure acting as back pressure on the pressure-increase piston operates the pressure-increase piston to pressurize fuel.

The pressure increase by the pressure-increase mechanism mentioned above is carried out in the case where the required injection pressure of fuel to be supplied to cylinders cannot be achieved only by common rail pressure. Specifically, in accordance with a map of FIG. 3, when the target injection pressure is increased with increase in the operated amount of an accelerator pedal (required load) and engine speed, the pressure-increase mechanism starts increasing fuel pressure based upon a pressure-increase flag set in a map of FIG. 4. For example, when a vehicle is running at low speed, a relatively low target injection pressure is set because engine load and engine speed are low, and therefore fuel injection is carried out with the pressure-increase mechanism being at a standstill. When the accelerator pedal is depressed in this state so as to accelerate the speed, the target injection pressure is increased in response to a rapid increase in required load, and the pressure-increase mechanism starts increasing fuel pressure so as to achieve the increased target injection pressure as shown in a time chart of FIG. 13.

The elimination of fuel pressure acting on the pressure-increase piston leads to consumption of pressurized fuel other than in fuel injection, and therefore the amount of pressurized fuel consumed considerably increases upon the start of pressure increase by the pressure-increase mechanism, and the quantity of fuel discharged from a supply pump is rapidly increased by necessity so as to maintain a predetermined common rail pressure. As a result, there is the problem that as shown in FIG. 13, when the amount of pressurized fuel consumed is abruptly changed in response to activation and deactivation of the pressure-increase mechanism, the quantity of fuel discharged from the supply pump (driving load) is abruptly changed, causing torque shock and rotational fluctuation to occur in an engine that drives the supply pump and therefore deteriorating drivability.

Also, the engine has a property of changing the state of combustion and thereby changing combustion noise depending on fuel injection pressure, and therefore when the target injection pressure is abruptly changed in response to depression of the accelerator pedal or the like, combustion noise is also abruptly changed, causing a driver to feel something is wrong.

SUMMARY OF THE INVENTION

An aspect of the present invention is a common rail fuel injection system that comprises a common rail that stores fuel pressurized by a pressurizing pump; fuel injection valves that inject the fuel stored in the common rail into respective cylinders of an engine; and a pressure-increase mechanism for introducing the fuel from the common rail to drive an increase-pressure piston and further pressurizing the fuel from the common rail so that fuel injection pressure can be arbitrarily increased, wherein the common rail fuel injection system further comprises a control means for gradually changing the quantity of fuel discharged from the pressurizing pump when at least one of activation and deactivation of the pressure-increase mechanism is carried out.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENTS

A description will now be given of a common rail fuel injection system of an engine for a vehicle according to a first embodiment of the present invention.

Figure 1:
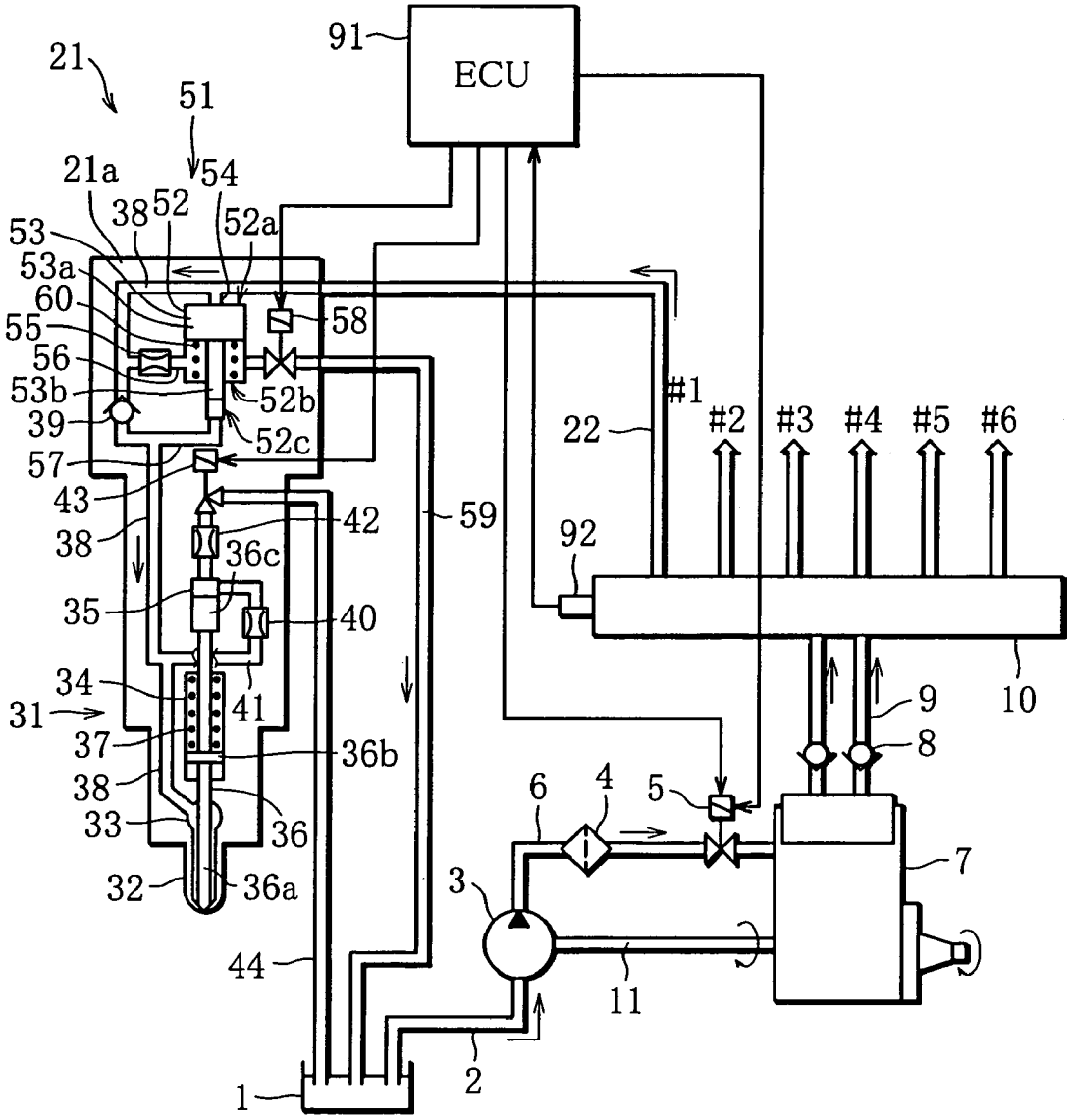
FIG. 1 is a diagram showing the overall construction of a common rail fuel injection system according to embodiments of the present invention.

FIG. 1 is a diagram showing the overall construction of the common rail fuel injection system according to the first embodiment. A fuel tank 1 disposed in a vehicle is connected to a feed pump 3 via a tank fuel passage 2. The feed pump 3 is connected to a supply pump 7 (pressurizing pump), which is provided with a filter 4 and an electromagnetic fuel supply amount adjusting valve 5, via a fuel feed passage 6. The supply pump 7 is connected to a common rail 10 via a pair of fuel supply passages 9 provided with respective check valves 8. In FIG. 1, the feed pump 3 and the supply pump 7 are separated from each other, but in actuality, the pumps 3 and 7 are configured as an integral unit and driven by an engine, not shown, via a common drive shaft 11.

Fuel in the fuel tank 1 is pumped up by the feed pump 3 and supplied to the supply pump 7 via the tank fuel passage 2 and the fuel feed passage 6 and is then pressurized by the supply pump 7 and supplied to the common rail 10 via the fuel supply passages 9. The quantity of fuel taken into the supply pump 7 is limited in accordance with the opening degree of the fuel supply amount adjusting valve 5, and accordingly, the quantity of fuel discharged from the supply pump 7 is controlled to adjust fuel pressure inside the common rail 10.

Fuel injection valves 21 provided in respective cylinders of the engine are connected to the common rail 10 via respective common rail fuel passages 22. Each of the fuel injection valves 21 has an end (lower side) thereof facing the inside of each cylinder. The fuel injection valve 21 is comprised mainly of a fuel injection mechanism 31 that controls fuel injection into the cylinder of the engine, and a pressure-increase mechanism 51 that increases the pressure of fuel, which is to be supplied to the fuel injection mechanism 31, in advance.

First, a description will now be given of the construction of the fuel injection mechanism 31. A nozzle 32, a fuel reservoir 33, a spring chamber 34, and a pressure chamber 35 are formed in this order from an end of a body 21*a* of the fuel injection valve 21. A head portion 36*a* of a needle valve 36 is disposed in the nozzle 32 and the fuel reservoir 33, a flange portion 36*b* of the needle valve 36 is disposed in the spring chamber 34, and a piston 36*c* of the needle valve 36 is disposed in the pressure chamber 35. The head portion 36*a*, the flange portion 36*b*, and the piston 36*c* are assembled into the needle valve 36. A spring 37 is interposed between the upper surface of the flange portion 36*b* of the needle valve 36 and the upper wall of the spring chamber 34. The spring 37 forces the needle valve 36 downward.

The common rail fuel passage 22 is connected to one end of a fuel supply passage 38 formed in the body 21*a* of the fuel injection valve 21, and the fuel supply passage 38 is provided with a check valve 39. The other end of the fuel supply passage 38 is connected to the fuel reservoir 33 of the fuel injection mechanism 31, and the fuel from the common rail fuel passage 22 is guided to the nozzle 32 via the fuel supply passage 38 and the fuel reservoir 33.

One end of a pressure passage 41 provided with an orifice 40 is connected to a point downstream (on the fuel reservoir 33 side) of the check valve 39 of the fuel supply passage 38, and the other end of the pressure passage 41 is connected to an upper part of the pressure chamber 35. Thus, fuel pressure inside the fuel supply passage 39 acts as back pressure on an upper surface of the piston 36*c* of the needle valve 36, which is located inside the pressure chamber 35, via the pressure passage 41, and on the other hand, fuel pressure directed upward acts on part of the needle valve 36 in the vicinity of the fuel reservoir 33. The resultant of the fuel pressure acting on the upper surface of the piston 36*c* of the needle valve 36 and the force of the spring 37 is greater than the fuel pressure acting on the fuel reservoir 33, and hence the needle valve 36 is forced downward to be held in the closed state in which the head portion 36*a* lies in pressure-contact with the nozzle 32.

An electromagnetic injection control valve 43 is connected to the upper part of the pressure chamber 35 via an orifice 42 and connected to the fuel tank 1 via a return passage 44. When the injection control valve 43 is opened, the fuel in the upper part of the pressure chamber 35 is collected into the fuel tank 1 via the return passage 44, so that the fuel pressure acting as back pressure on the upper surface of the piston 36*c* of the needle valve 36 is rapidly decreased. As a result, the magnitude relationship between the above-mentioned fuel pressures is reversed, and the needle valve 36 is forced upward and switched to the opened state.

On the other hand, the pressure-increase mechanism 51 is provided on the upper side of the fuel injection mechanism 31. A cylinder 52 of the pressure-increase mechanism 51 is provided in the body 21*a* of the fuel injection valve 21. A pressure-increase piston 53 is disposed in the cylinder 52 such that it is movable up and down, and is forced upward by a spring 60. The pressure-increase piston 53 is comprised of a large-diameter part 53*a* on the upper side and a small-diameter part 53*b* on the lower side. The large-diameter part 53*a* of the pressure-increase piston 53 partitions the cylinder 52 into an upper cylinder chamber 52*a* and a lower cylinder chamber 52*b*, and a pressurizing chamber 52*c* is disposed on the lower side of the small-diameter part 53*b* of the pressure-increase piston 53.

A point of the fuel supply passage 38 upstream of the check valve 39 is connected to the upper cylinder chamber 52*a* via an upper supply passage 54 and connected to the lower cylinder chamber 52*b* via a lower supply passage 56 provided with an orifice 55, so that the fuel is introduced into the cylinder chambers 52*a* and 52*b*. Also, a point of the fuel supply passage 38 downstream of the check valve 39 is connected to the pressurizing chamber 52*c* via a pressurizing passage 57, so that the fuel is introduced into the pressurizing chamber 52*c* as well. The resultant of fuel pressure acting on a lower surface of the large-diameter part 53*a* of the pressure-increase piston 53 and the force of the spring 60 is greater than fuel pressure acting on an upper surface of the large-diameter part 53*a*, and hence the pressure-increase piston 53 is forced upward to keep the capacity of the pressurizing chamber 52*c* at the maximum.

An electromagnetic pressure-increase control valve 58 is connected to the lower cylinder chamber 52*b* of the pressure-increase mechanism 51 and connected to the fuel tank 1 via a return passage 59. When the pressure-increase control valve 58 is opened, the fuel in the lower cylinder chamber 52*b* is returned to the fuel tank 1 via the return passage 59, so that the fuel pressure acting as back pressure on the lower surface of the large-diameter part 53*a* of the pressure-increase piston 53 is rapidly decreased. As a result, the magnitude relationship between the above-mentioned fuel pressures is reversed, and the pressure-increase piston 53 is forced downward to reduce the capacity of the pressurizing chamber 52*c*.

On the other hand, an ECU 91 that is comprised of input/output devices, storage devices (such as a ROM and a RAM) for storing control programs, control maps, and so on, a central processing unit (CPU), a timer counter, and others, which are not illustrated, is disposed in a vehicle compartment. Sensors such as a rail pressure sensor 92 that detects fuel pressure inside the common rail 10, an accelerator pedal sensor that detects the operated amount of an accelerator pedal, not shown, a cylinder discriminating sensor for discriminating between the cylinders, and a crank angle sensor that outputs a crank angle signal in synchronism with the rotation of the engine are connected to the input side of the ECU 91. On the other hand, devices such as the fuel supply amount adjusting valve 5, the injection control valves 43 and increase control valves 58 of the fuel injection valves 21 in the respective cylinders are connected to the output side of the ECU 91.

The ECU 91 sets target values for common rail pressure, fuel injection quantity, fuel injection timing, whether or not fuel pressure is to be increased by the pressure-increase mechanism 51, timing of operation of the pressure-increase mechanism 51, and so on based on various information relating to the operating state of the engine such as the operated amount of the accelerator pedal (engine load) detected by the accelerator pedal sensor and the engine speed calculated from a crank angle signal from the crank angle sensor, and drivingly controls the fuel supply amount adjusting valve 5, the injection control valves 43, and the pressure-increase control valves 58 to carry out fuel injection with the optimum injection pressure waveform best-suited to the operating state of the engine.

A description will now be given of how the common rail fuel injection system operates, particularly how the pressure-increase mechanism 51 operates based on processing carried out by the ECU 91.

The fuel in the fuel tank 1 is pumped up by the feed pump 3, which is driven by the engine, and supplied to the supply pump 7, after iron powders are removed from the fuel by the filter 4, via the tank fuel passage 2 and the fuel feed passage 6. The fuel is further pressurized by the supply pump 7 and supplied to the common rail 10 via the supply fuel passage 9. The ECU 91 controls the opening degree of the fuel supply amount adjusting valve 5 to limit the quantity of fuel taken into the supply pump 7 so as to adjust the quantity of fuel to be discharged, and feedback-controls the actual rail pressure detected by the rail pressure sensor 92 to a target value for rail pressure.

On the other hand, the fuel injection valve 21 operates as described below in response to opening and closing of the fuel control valve 43 and the pressure-increase control valve 58.

The fuel in the common rail 10 is supplied to the fuel injection valve 21 of each cylinder via the common rail fuel passage 22. In the body 21*a* of each fuel injection valve 21, the fuel is guided to the nozzle 32 via the fuel supply passage 38 of the fuel injection mechanism 31 and the fuel reservoir 33, and on the other hand, guided to the upper part of the pressure chamber 35 via the pressure passage 41. When the injection control valve 43 is closed, fuel pressure acting as back pressure on the upper surface of the piston 36*c* of the needle valve 36 forces the needle valve 36 downward, so that the needle valve 36 is held in the closed state.

Also, the fuel from the common rail fuel passage 22 is introduced into the upper cylinder chamber 52*a* of the pressure-increase mechanism 51 via the upper supply passage 54, and on the other hand, introduced into the lower cylinder chamber 52*b* via the lower supply passage 56 and also introduced into the pressurizing chamber 52*c* via a pressurizing passage 57. As a result, fuel pressure acts on the upper and lower surfaces of the large-diameter part 53*a* of the pressure-increase piston 53. When the pressure-increase control valve 58 is closed, the fuel pressure acting as back pressure on the lower surface of the large-diameter part 53*a* of the pressure-increase piston 53 forces the pressure-increase piston 53 upward to keep the capacity of the pressurizing chamber 52*c* at the maximum.

In this state, when the injection control valve 43 is opened, the fuel in the upper part of the pressure chamber 35 is returned to the fuel tank 1 via the return passage 44, so that the fuel pressure acting as back pressure on the upper surface of the piston 36*c* of the needle valve 36 is rapidly decreased, causing the needle valve 36 to be forced upward and switched to the opened state, so that fuel injection from the nozzle 32 is started. Thereafter, when the injection control valve 43 is closed, the flow of fuel into the fuel tank 1 is stopped to restore the previous fuel pressure acting on the upper part of the piston 36*c*, and hence the needle valve 36 is forced downward again to return to the closed state, so that fuel injection is stopped.

In the above description, it is assumed that fuel with a common rail pressure is injected as it is without being increased in pressure by the pressure-increase mechanism 51, but in the case where fuel pressure is increased by the pressure-increase mechanism 51, the pressure-increase control valve 58 is driven to be opened and closed in predetermined timing in response to opening and closing of the injection control valve 43.

Figure 2:
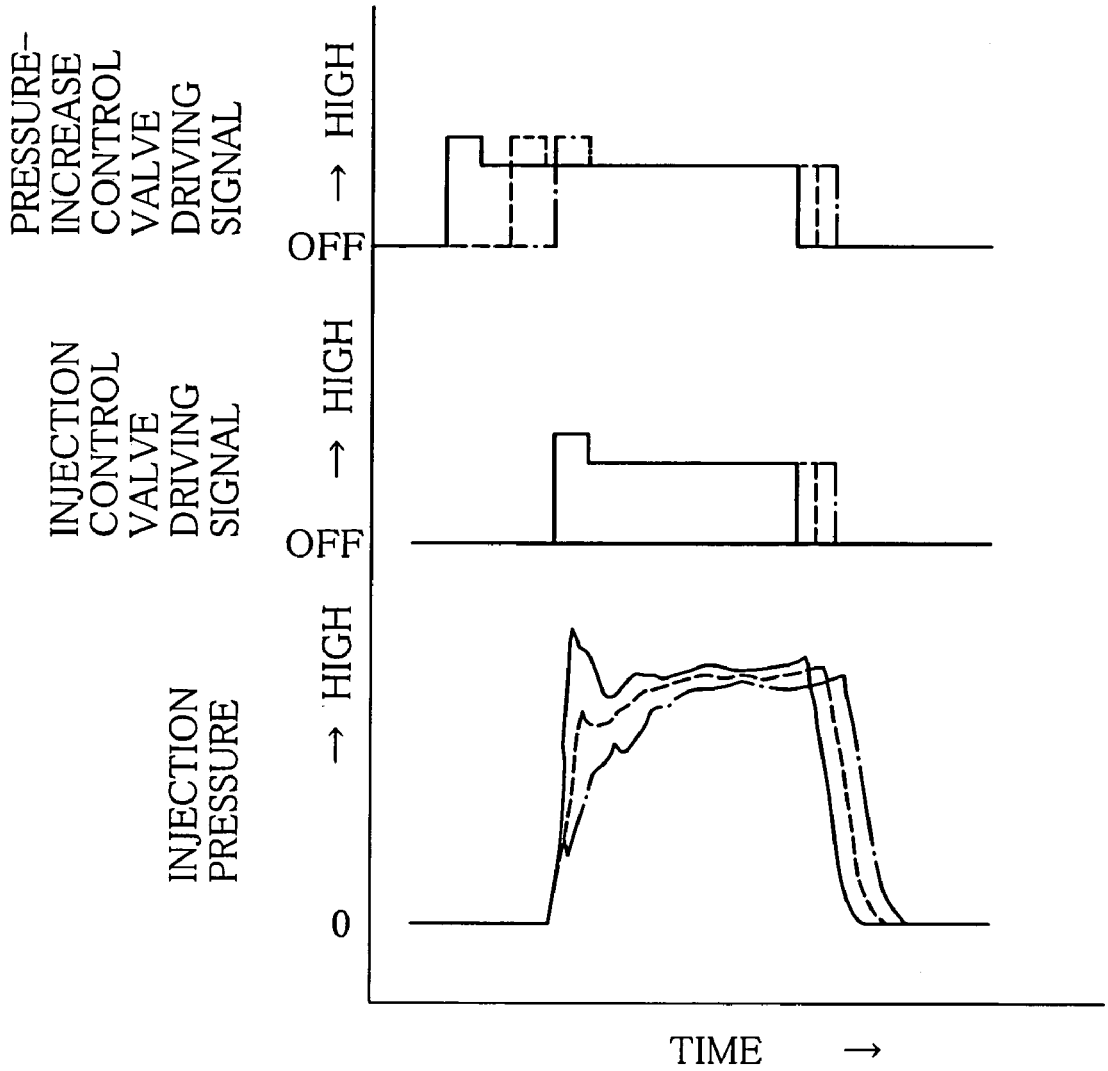
FIG. 2 is a diagram showing the relationship between the timing of activation of a pressure-increase mechanism and injection pressure waveforms.

For example, as indicated by solid lines in FIG. 2, the pressure-increase control valve 58 of the pressure-increase mechanism 51 is opened in predetermined timing prior to opening of the injection control valve 43. When the pressure-increase control valve 58 is opened, the fuel inside the lower cylinder chamber 52*b* is returned to the fuel tank 1 via the return passage 59, and the fuel pressure acting as back pressure on the lower surface of the large-diameter part 53*a* of the pressure-increase piston 53 is rapidly decreased, so that the pressure-increase piston 53 is forced downward to reduce the capacity of the pressurizing chamber 52*c*. That is, the fuel inside the pressurizing chamber 52*c* is pressurized at the small-diameter part 53*b* side making use of the fuel pressure acting on the large-diameter part 53*a* of the pressure-increase piston 53, and therefore the pressure of fuel downstream of the check valve 39 in the fuel supply passage 38 (i.e. the pressure of fuel in the pressurizing chamber 52*c*, the fuel supply passage 38, the fuel reservoir 33, and the nozzle 32) is increased from the original fuel pressure equivalent to the common rail pressure. On this occasion, the ratio of increase in fuel pressure is determined in advance depending on the specifications of the pressure-increase mechanism 51 such as the area ratio of the large-diameter part 53*a* to the small-diameter part 53*b* of the pressure-increase piston 53.

Thus, when the injection control valve 43 is then opened, the injection pressure sharply rises at the initial stage of injection and is kept at a higher pressure than the common rail pressure. Thereafter, when the injection control valve 43 and the pressure-increase control valve 58 are closed in tandem, the injection pressure is rapidly decreased, causing fuel injection to stop. As indicated by broken lines or chain lines in FIG. 2, the later the timing of opening of the pressure-increase control valve 58 (closer to the timing of opening of the injection control valve 43), the more gently the fuel injection pressure rises at the initial stage of injection, realizing an injection pressure waveform with initial injection suppressed. On the basis of such characteristics, the ECU 91 controls the timing of opening of the pressure-increase control valve 58 according to the operated amount of the accelerator pedal, the engine speed, and so on, thereby constantly making adjustments to realize the injection pressure waveform best-suited to the operating state of the engine.

Figure 3:
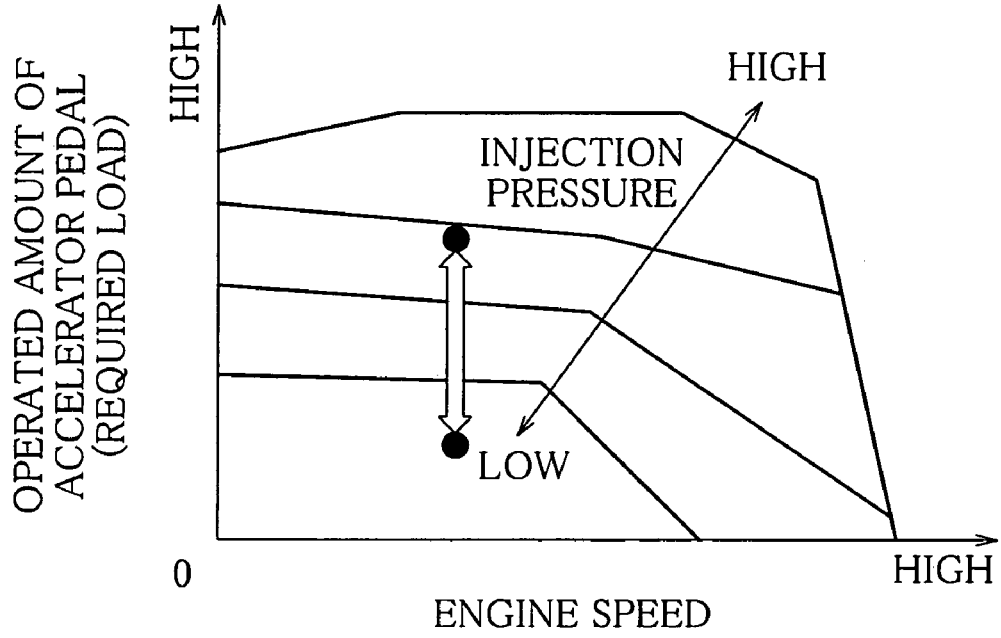
FIG. 3 is a view showing a map for setting a target injection pressure.

On the other hand, the ECU 91 sets a target value for the injection pressure of the fuel injection valve 21 based on the operated amount of the accelerator pedal (required load) and the engine speed in accordance with a map of FIG. 3, and as the operated amount of the accelerator pedal and the engine speed are increased, the ECU 91 provides control to increase the target injection pressure, thereby securing the required output. Also, the ECU 91 sets a pressure-increase flag based on the operated amount of the accelerator pedal and the engine speed in accordance with a map in FIG. 4. The ECU 91 resets (turns OFF) the pressure-increase flag in an operation range where the operated amount of the accelerator pedal and the engine speed are less than predetermined values and the target injection pressure can be achieved only by common rail pressure, and sets (turns ON) the pressure-increase flag in an operation range where the operated amount of the accelerator pedal and the engine speed are not less than predetermined values and the target injection pressure cannot be achieved only by common rail pressure, so that the pressure-increase mechanism 51 is activated or deactivated in accordance with the setting of the pressure-increase flag.

As mentioned above, during pressure increase by the pressure-increase mechanism 51, the fuel acting as back pressure is returned to the fuel tank 1 each time the fuel is injected, and therefore the quantity of pressurized fuel consumed is considerably increased. For this reason, the quantity of fuel discharged from the supply pump 7 is rapidly increased by necessity so as to maintain a predetermined common rail pressure. Therefore, driving load of the supply pump 7 is abruptly changed with change in the quantity of fuel discharged from the supply pump 7 in response to activation and deactivation of the pressure-increase mechanism 51, causing torque shock and rotational fluctuations to occur in the engine, and also, combustion noise as well as the state of combustion is abruptly changed with change in fuel injection pressure, causing a driver to feel something is wrong.

To address this problem, in the present embodiment, a pressure-increase transition mode is executed when the pressure-increase flag is switched, thereby preventing an abrupt change in combustion noise mainly caused by a change in fuel injection pressure. A detailed description will now be given of the pressure-increase transition mode.

Figure 5:
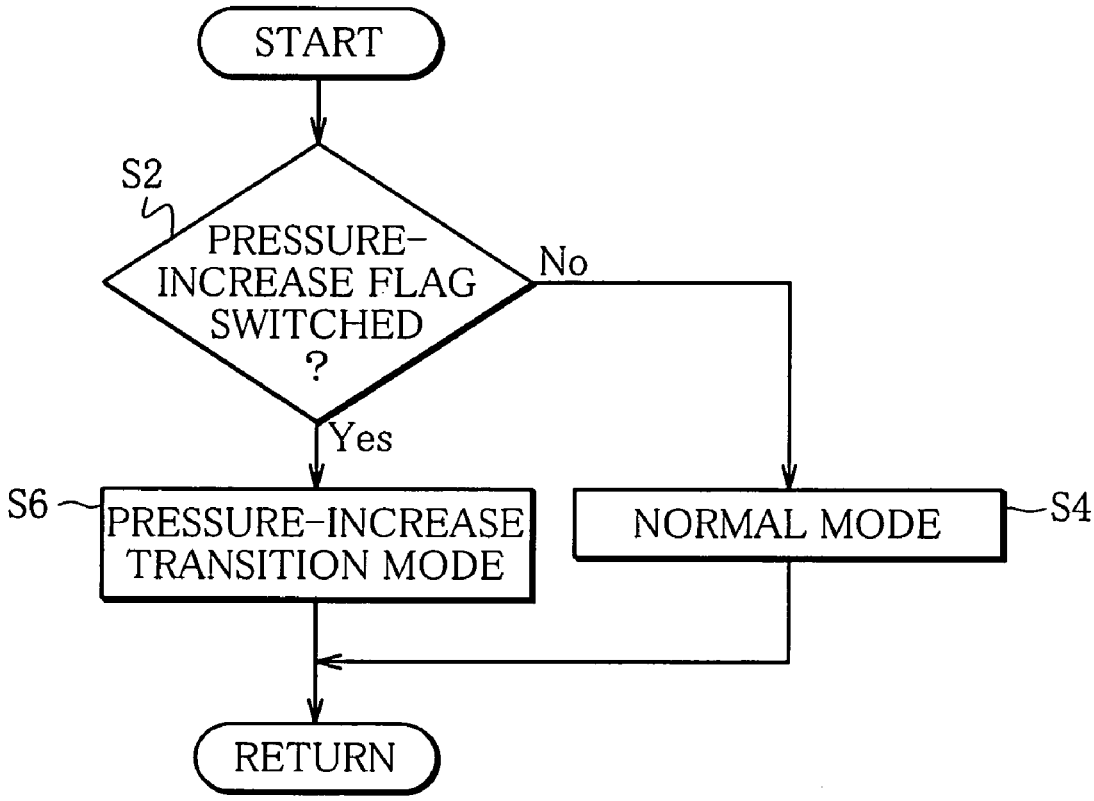
FIG. 5 is a flow chart showing a mode switching routine executed by an ECU.

The ECU 91 executes a mode selecting routine shown in FIG. 5 at predetermined control intervals. First, in a step S2, the ECU 91 determines whether or not the pressure-increase flag has been switched. If the pressure-increase flag has not been switched and the determination result in the step S2 is No (negative), the process proceeds to a step S4 wherein a normal mode is executed, and the routine is terminated on a temporary basis. The normal mode is a mode that is executed when the pressure-increase mechanism 51 is continuously operated or kept at a standstill, and in that the period of time for which fuel pressure is increased by the pressure-increase mechanism, pressure-increase timing when the fuel pressure is increased by the pressure-increase mechanism 51, common rail pressure, and so on are controlled using a normal procedure in accordance with set values based on maps.

On the other hand, if the pressure-increase flag has been switched and the determination result in the step S2 is Yes (positive), the process proceeds to a step S6 wherein the pressure-increase transition mode is executed, and the routine is then terminated. Thus, each time the pressure-increase flag is switched, the pressure-increase transition mode is executed in the step S6. The pressure-increase transition mode is a mode that is transiently executed when the pressure-increase flag is switched. In the present embodiment, pressure-increase delay control in which the actual pressure increase is started and stopped after a delay in response to switching of the pressure-increase flag, and rail-pressure ramp control in which the target rail pressure is gradually changed in response to activation and deactivation of the pressure-increase mechanism 51.

Figure 6:
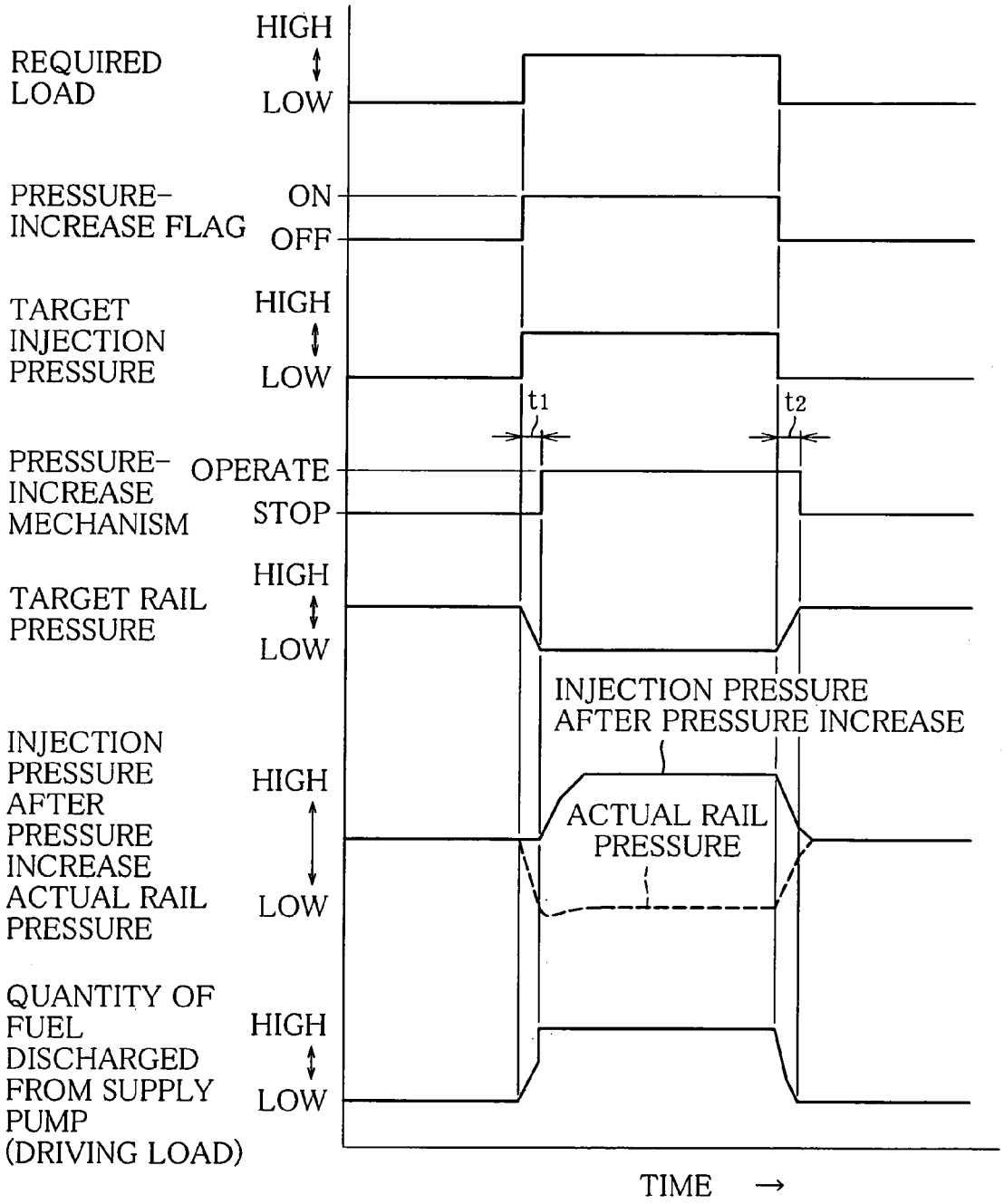
FIG. 6 is a time chart showing how pressure-increase delay control and rail-pressure ramp control are carried out according to a first embodiment of the present invention.

FIG. 6 is a time chart showing how pressure-increase delay control and rail-pressure ramp control are carried out. FIG. 6 illustrates a process in the case where the pressure-increase flag is switched in accordance with the increase and decrease of the operated amount of the accelerator pedal (required load), but it is not limited to such case. The same process as illustrated in FIG. 6 may be carried out, when the pressure-increase flag is switched in accordance with the increase and decrease of the engine speed or in accordance with the increase and decrease of both of the operated amount of the accelerator pedal and the engine speed.

Figure 4:
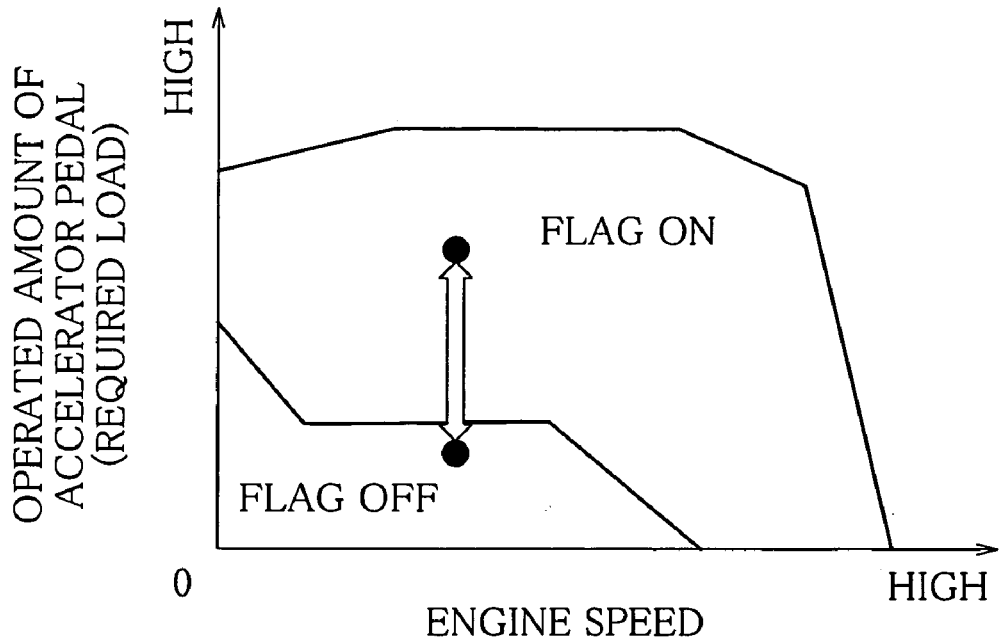
FIG. 4 is a view showing a map for setting a pressure-increase flag.
Figure 13:
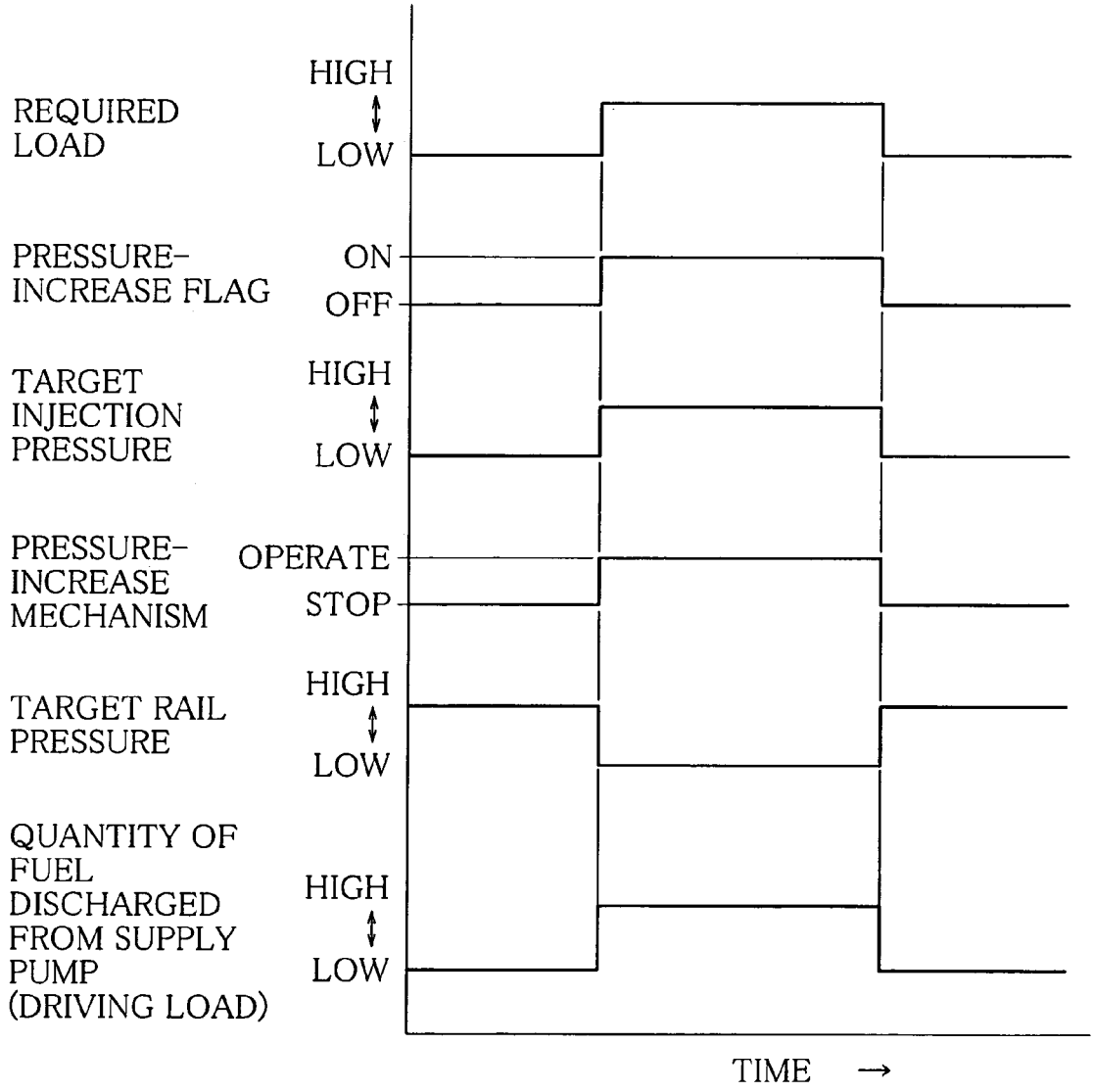
FIG. 13 is a time chart showing how a pressure-increase mechanism operates according to a prior art.

When the required load is rapidly increased upon depression of the accelerator pedal, the target injection pressure is rapidly increased in the map in FIG. 3, and the pressure-increase flag is set in the map in FIG. 4. The pressure-increase mechanism 51 increases fuel pressure at a predetermined pressure-increase ratio, and hence to maintain a desired target injection pressure, it is necessary to reduce common rail pressure at the same time as the start of pressure increase in expectation of an increase in target injection pressure. In a conventional corresponding process, the target rail pressure is reduced step by step as shown in FIG. 13, but in the present embodiment, the target rail pressure is gently reduced at a predetermined rate of change by the above-mentioned rail pressure ramp control (rail pressure ramp control means). As a result of control of the supply pump 7 based on the target rail pressure, the actual rail pressure is also gently reduced as indicated by the broken line in FIG. 6, and an abrupt change in fuel injection pressure after pressure increase can be prevented as compared with the case where the target rail pressure is reduced step by step as conventionally.

Also, in response to setting of the pressure-increase flag, the above-mentioned pressure-increase delay control is carried out to activate the pressure-increase mechanism 51 in timing delayed by a delay time period t1 set in advance (pressure-increase delay control means). Although in FIG. 6, the pressure-increase mechanism 51 is activated in timing in which reduction in target rail pressure is completed, this is not limitative, but the activation of the pressure-increase mechanism 51 and the completion of reduction in target rail pressure may be in tandem.

In not only the case where the target rail pressure is gently reduced as in the present embodiment but also the case where the target rail pressure is reduced step by step as conventionally, there is a short delay before the target rail pressure is reflected on the actual rail pressure through the control of the supply pump 7, and hence when pressure increase is started before the actual rail pressure is reduced down to the target rail pressure, fuel injection pressure after pressure increase temporarily exceeds the target injection pressure to increase NOx. Since the activation of the pressure-increase mechanism 51 is delayed by the delay time period t1 after reduction in target rail pressure is started as mentioned above, pressure increase is started in the optimum timing in which the actual rail pressure becomes equal to the target rail pressure, and fuel injection pressure after pressure increase is maintained at the target injection pressure without being temporarily rapidly increased.

On the other hand, in the case where required load is rapidly decreased upon release of the accelerator pedal, the above procedure is reversed. Specifically, in response to resetting of the pressure-increase flag in the map in FIG. 4, the target rail pressure is gently increased at a predetermined rate of change by the rail pressure ramp control, and as a result, the actual rail pressure is also gently increased.

On this occasion, if the pressure-increase is stopped due to a delay in the control of rail pressure before the actual rail pressure increases to the target rail pressure, fuel injection pressure after pressure increase is rapidly reduced on a temporary basis to become lower than the target injection pressure to increase smoke, but in the present embodiment, the pressure-increase delay control is carried out to stop the pressure-increase mechanism 51 with a delay of a delay time period t2 after the pressure-increase flag is reset (increase in target rail pressure is started), and therefore the pressure increase is stopped in the optimum timing in which the actual rail pressure becomes equal to the target rail pressure, and fuel injection pressure is maintained at the target injection pressure without being rapidly reduced on a temporary basis after the pressure increase is stopped. It should be noted that the delay timer periods t1 and t2 may be set to either the same value or different values.

As described above, in the common rail fuel injection system according to the present embodiment, the rail-pressure ramp control is carried out to increase and decrease the target rail pressure at a predetermined rate of change to prevent an abrupt change in actual rail pressure with activation and deactivation of the pressure-increase mechanism 51, and as a result, an abrupt change in fuel injection pressure after pressure increase can also be prevented, thereby preventing a situation in which a driver feels something is wrong due to an abrupt change in combustion noise as well as the state of combustion with change in fuel injection pressure.

Also, since the pressure-increase delay control is carried out to delay the activation and deactivation of the pressure-increase mechanism 51 in response to setting and resetting of the pressure-increase flag, pressure increase is started or stopped in the optimum timing in which the actual rail pressure becomes equal to the target rail pressure, and it is possible to prevent a situation in which fuel injection pressure is rapidly increased on a temporary basis to rapidly increase NOx due to the start of pressure increase in inappropriate timing, and a situation in which fuel injection pressure is rapidly reduced to rapidly increase smoke due to the stop of pressure increase in inappropriate timing. As a result, exhaust gas characteristics of the engine can be improved.

Next, a description will be given of a common rail fuel injection system of an engine for a vehicle according to a second embodiment of the present invention. The common rail fuel injection system according to the present embodiment is identical in hardware configuration with the common rail fuel injection system according to the first embodiment described above. A difference between the present embodiment and the first embodiment lies in the pressure-increase transition mode executed by the ECU 91. In the present embodiment, blank valve action control in which the pressure-increase mechanism 51 is activated (the pressure-increase control valve 58 is opened) in timing irrelevant to fuel injection is carried out as the pressure-increase transition mode so as to mainly suppress torque shock and rotational fluctuations in the engine. Therefore, description of elements and parts identical in construction with those of the first embodiment is omitted, and how the blank valve action control that is the point of difference is carried out will be focused on in the following description.

Figure 7:
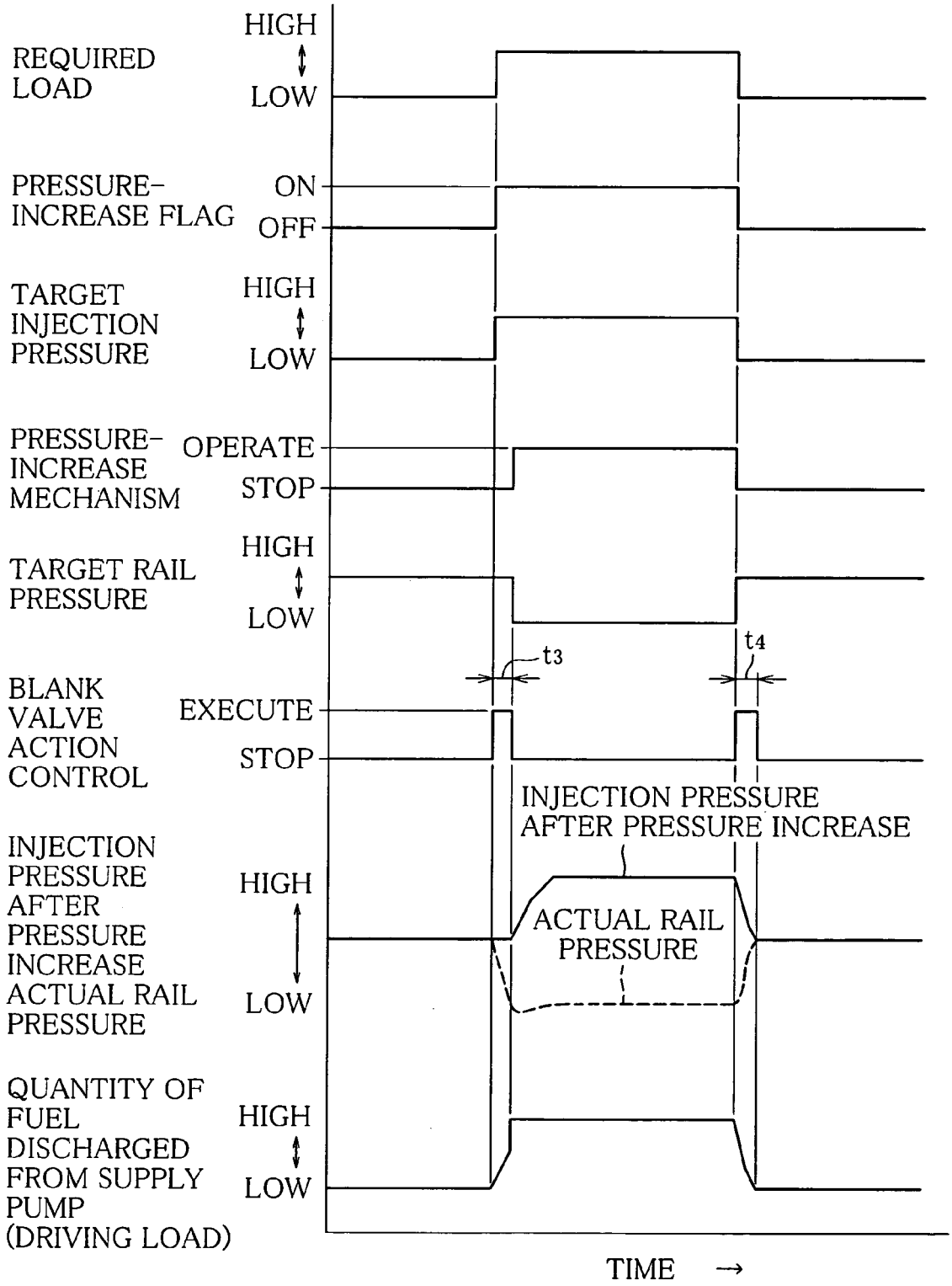
FIG. 7 is a time chart showing how blank valve action control is carried out according to a second embodiment of the present invention.
Figure 8:
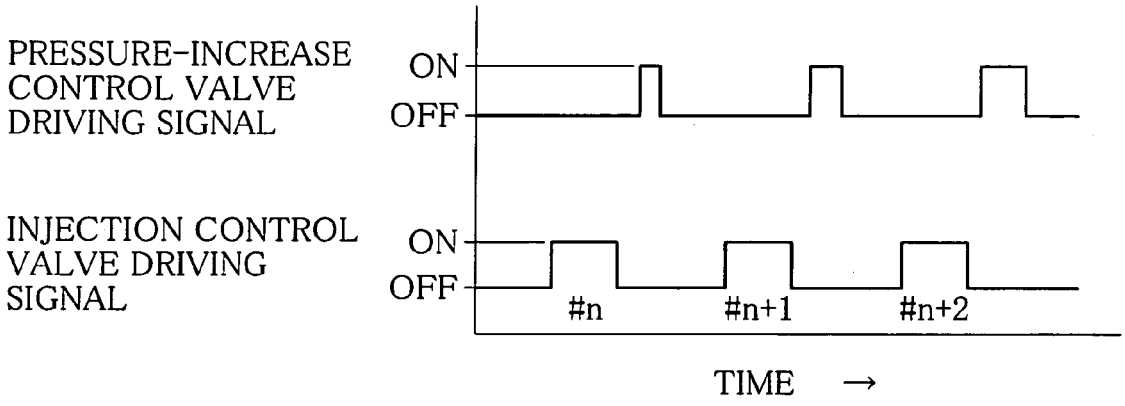
FIG. 8 is a time chart showing how fuel pressure is increased for fuel injection during the blank valve action control.

FIG. 7 is a time chart showing how the blank valve action control is carried out, and FIG. 8 is a time chart showing how fuel pressure is increased for fuel injection during the blank valve action control. When the required load is rapidly increased upon depression of the accelerator pedal, the target injection pressure is rapidly increased, and the pressure-increase flag is set. In response to the setting of the pressure-increase flag, the pressure-increase mechanism 51 starts increasing fuel pressure after a delay of a time period t3. In synchronism with this, the target rail pressure is decreased, and the blank valve action control is carried out in the delay time period t3.

It goes without saying that, after the lapse of the delay time period t3, fuel pressure is increased in timing that overlaps fuel injection, in other words, timing in which fuel injection pressure can be increased from common rail pressure by operation of the pressure-increase mechanism 51. As shown in FIG. 8, however, the injection pressure of fuel that is actually injected is not increased during the blank valve action control because the pressure-increase control valve 58 of the fuel injection valve 21 for each cylinder is opened in timing that does not overlap the timing of opening of the injection control valve 43. Also, the period of time for which the pressure-increase control valve 58 is opened is controlled to be gradually increased at a predetermined rate of change after the start of the delay time period t3, so that after the lapse of the delay time period t3, the period of time for which the pressure-increase control valve 58 is opened corresponds to the period of time for which the pressure-increase control valve 58 is opened (this period of time is set based on the operated amount of the accelerator pedal and the engine speed) so as to increase fuel injection pressure (blank valve action control means).

Since the pressure-increase mechanism 51 is operated in timing irrelevant to fuel injection, fuel injection is carried out based on common rail pressure with fuel injection pressure being not increased in the delay time period t3. The blank valve action control gently increases the consumption of pressurized fuel with operation of the pressure-increase mechanism 51 in the delay time period t3, and after the lapse of the delay time period t3, the increase of fuel pressure is started in this state, and therefore it is possible to prevent a situation in which the consumption of pressurized fuel is abruptly changed when the pressure-increase mechanism 51 is activated from standstill.

On the other hand, when the required load is rapidly decreased upon release of the accelerator pedal, the increase of fuel pressure by the pressure-increase mechanism 51 is stopped and the target rail pressure is increased at the same time when the pressure-increase flag is reset. The blank valve action control is carried out until a delay time period t4 elapses after the increase of fuel pressure is stopped. In the blank valve action control, the pressure-increase control valve 58 for each cylinder is opened in timing that does not overlap the timing of opening of the injection control valve 43. Also, the period of time for which the pressure-increase control valve 58 is opened is controlled to be gradually decreased at a predetermined rate of change from the period of time for which the pressure-increase control valve 58 was opened when the increase of fuel pressure was stopped, so that after the lapse of the delay time period t4, the period of time for which the pressure-increase control valve 58 is opened becomes equal to 0. This prevents a situation in which the consumption of pressurized fuel is abruptly changed when the pressure-increase mechanism 51 that has been operating is deactivated.

As described above, in the common rail fuel injection system according to the present embodiment, the blank valve action control is carried out before activation of the pressure-increase mechanism 51 so that the quantity of pressurized fuel consumed by the pressure-increase mechanism 51 can be gradually increased, and on the other hand, the blank valve action control is carried out after deactivation of the pressure-increase mechanism 51 so that the quantity of pressurized fuel consumed by the pressure-increase mechanism 51 can be gradually decreased. It is therefore possible to prevent an abrupt change in the consumption of pressurized fuel in response to activation and deactivation of the pressure-increase mechanism 51 and to prevent a situation in which the driving load of the supply pump 7 is abruptly changed with change in the quantity of fuel discharged from the supply pump 7. As a result, it is possible to suppress torque shock and rotational fluctuations in the engine caused by an abrupt change in driving load, thereby realizing a desirable drivability.

Next, a description will be given of a common rail fuel injection system of an engine for a vehicle according to a third embodiment of the present invention. The common rail fuel injection system according to the present embodiment is identical in hardware configuration with the common rail fuel injection system according to the first embodiment described above. A difference between the present embodiment and the first embodiment lies in the pressure-increase transition mode executed by the ECU 91. In the present embodiment, pressure-increase time period control in which the pressure-increase time period (the period of time for which the pressure-increase control valve 58 is opened) is continuously changed when the increase of fuel pressure is started and stopped is carried out as the pressure-increase transition mode so as to mainly suppress torque shock and rotational fluctuations in the engine and prevent an abrupt change in combustion noise. Therefore, description of elements and parts identical in construction with those of the first embodiment is omitted, and how the pressure-increase time period control that is the point of difference is carried out will be focused on below.

Figure 10:
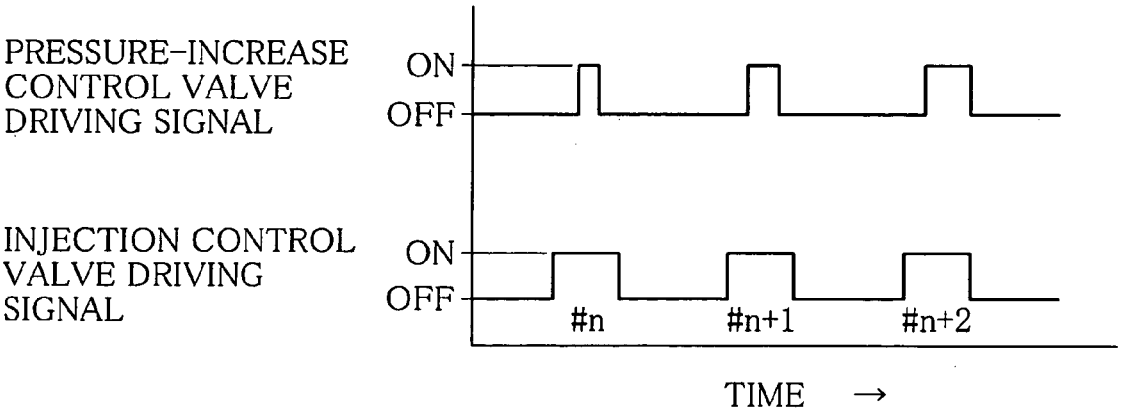
FIG. 10 is a time chart showing how fuel pressure is increased for fuel injection during the pressure-increase time period control.
Figure 9:
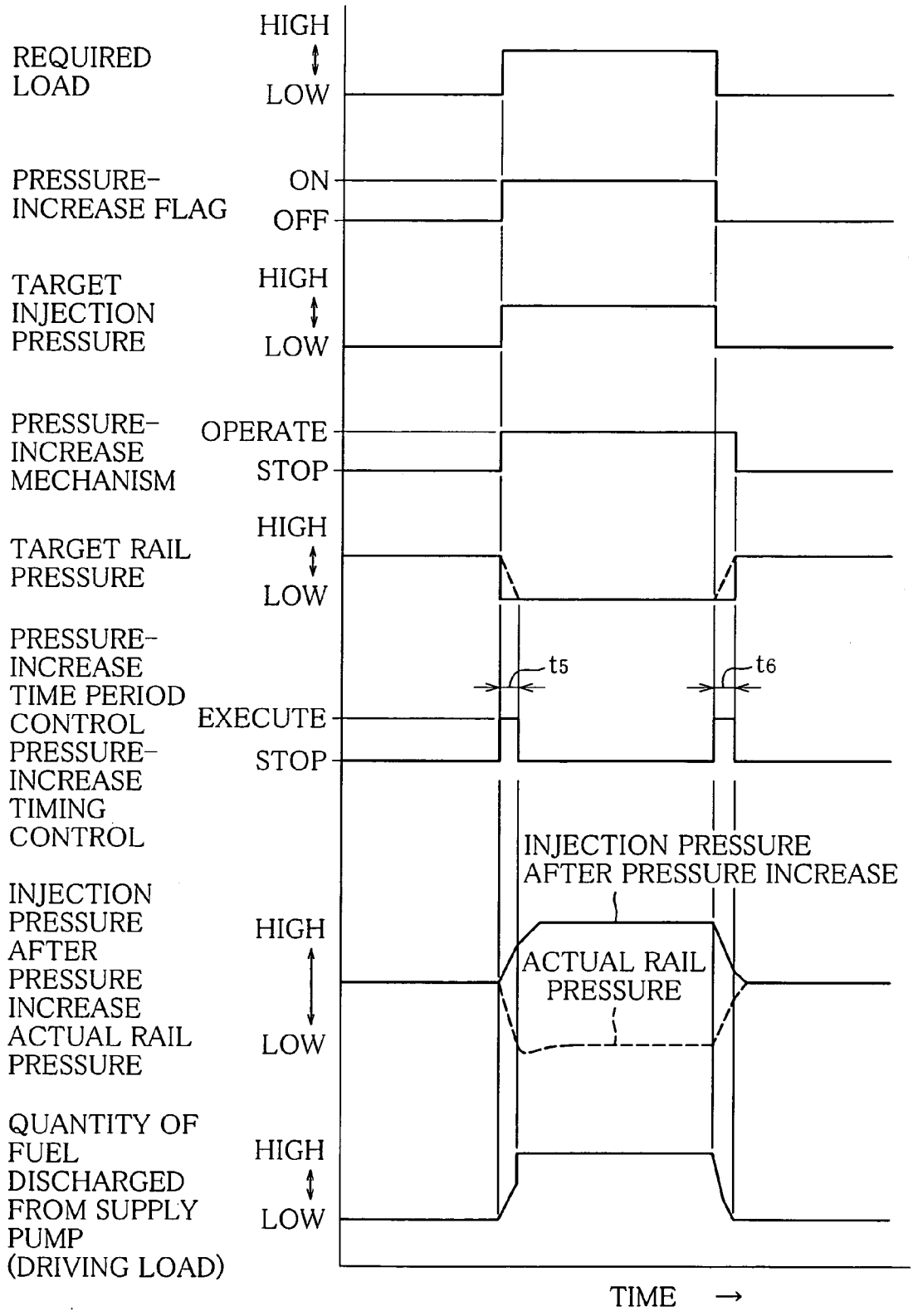
FIG. 9 is a time chart showing how pressure-increase time period control according to a third embodiment of the present invention and pressure-increase timing control according to a fourth embodiment of the present invention are carried out.

FIG. 9 is a time chart showing how the pressure-increase time period control is carried out, and FIG. 10 is a time chart showing how fuel pressure is increased for fuel injection during the pressure-increase time period control. When the required load is rapidly increased upon depression of the accelerator pedal, the target injection pressure is rapidly increased, and the pressure-increase flag is set. In synchronism with this, the pressure-increase mechanism 51 starts increasing fuel pressure, and the target rail pressure is decreased. The pressure-increase time period control is carried out until a delay timer period 5 elapses after the pressure-increase flag is set.

In the pressure-increase time period control, the period of time for which the pressure-increase control valve 58 for each engine is opened is controlled to be gradually increased at a predetermined rate of change after the start of the delay time period t5, so that after the lapse of the delay time period t5, the period of time for which the pressure-increase control valve 58 is opened corresponds to the original period of time for which the pressure-increase control valve 58 is opened during the increase of fuel pressure (pressure-increase time period control means). Therefore, even when the pressure-increase mechanism 51 starts increasing fuel pressure, the period of time for which the pressure-increase control valve 58 is opened is not sharply increased but gently increased. Accordingly, the quantity of fuel flowing out from the common rail 10 is also gently increased, and fuel injection pressure is gradually increased.

On the other hand, when the required load is rapidly decreased upon release of the accelerator pedal, the pressure-increase mechanism 51 continues to increase fuel pressure even when the pressure-increase flag is reset, and when a delay time period t6 has elapsed after the resetting of the pressure-increase flag, the increase of fuel pressure is stopped, and the target rail pressure is increased. Thus, the pressure-increase time period control is carried out in the delay time period t6 as well. In the pressure-increase time period control carried out on this occasion, the period of time for which the pressure-increase control valve 58 is opened is controlled to be gradually decreased at a predetermined rate of change from the original period of time for which the pressure-increase control valve 58 is opened during the increase of fuel pressure, so that after the lapse of the delay time period t6, the period of time for which the pressure-increase control valve 58 is opened becomes equal to 0. Accordingly, the quantity of fuel flowing out from the common rail 10 is also gently decreased, and fuel injection pressure is gradually decreased.

As described above, in the common rail fuel injection system according to the present embodiment, the pressure-increase time period control is carried out when the pressure-increase mechanism 51 is activated, so that the period of time for which the pressure-increase control valve 58 is opened can be gradually increased, and on the other hand, the pressure-increase time period control is carried out when the pressure-increase mechanism 51 is deactivated, so that the period of time for which the pressure-increase control valve 58 is opened can be gradually decreased. It is therefore possible to prevent an abrupt change in the consumption of pressurized fuel when the pressure-increase mechanism 51 is activated and deactivated, and to prevent a situation in which the driving load of the supply pump 7 is abruptly changed with change in the volume of fuel discharged from the supply pump 7. As a result, it is possible to suppress torque shock and rotational fluctuations in the engine caused by an abrupt change in driving load, thereby realizing a desirable drivability.

Also, the period of time for which the pressure-increase control valve 58 is opened, i.e. the period of time for which the pressure-increase mechanism 51 increases fuel pressure is a factor that determines fuel injection pressure after pressure increase, and hence the pressure-increase time period control prevents an abrupt change in fuel injection pressure when the pressure-increase mechanism 51 is activated and deactivated. It is therefore possible to prevent a situation in which combustion noise as well as the state of combustion is abruptly changed with change in fuel injection pressure to cause a driver to feel something is wrong when the operating state of the pressure-increase mechanism 51 is switched, and to suppress transitional increase in NOx and smoke caused by an abrupt change in the state of combustion.

It should be noted that instead of increasing and decreasing the target rail pressure step by step, the target rail pressure may be continuously increased and decreased with increase and decrease in the period of time for which the pressure-increase control valve 58 is opened in the delay times t5 and t6, as indicated by the broken lines in FIG. 9.

Next, a description will be given of a common rail fuel injection system of an engine for a vehicle according to a fourth embodiment of the present invention. The common rail fuel injection system according to the present embodiment is identical in hardware configuration with the common rail fuel injection system according to the first embodiment described above. A difference between the present embodiment and the first embodiment lies in the pressure-increase transition mode executed by the ECU 91. In the present embodiment, pressure-increase timing control in which the timing of pressure increase (the timing of opening of the pressure-increase control valve 58) is continuously changed when the increase of fuel pressure is started and stopped is carried out as the pressure-increase transition mode so as to prevent an abrupt change in combustion noise. Therefore, description of elements and parts identical in construction with those of the first embodiment is omitted, and how the pressure-increase timing control that is the point of difference is carried out will be focused on below.

Figure 11:
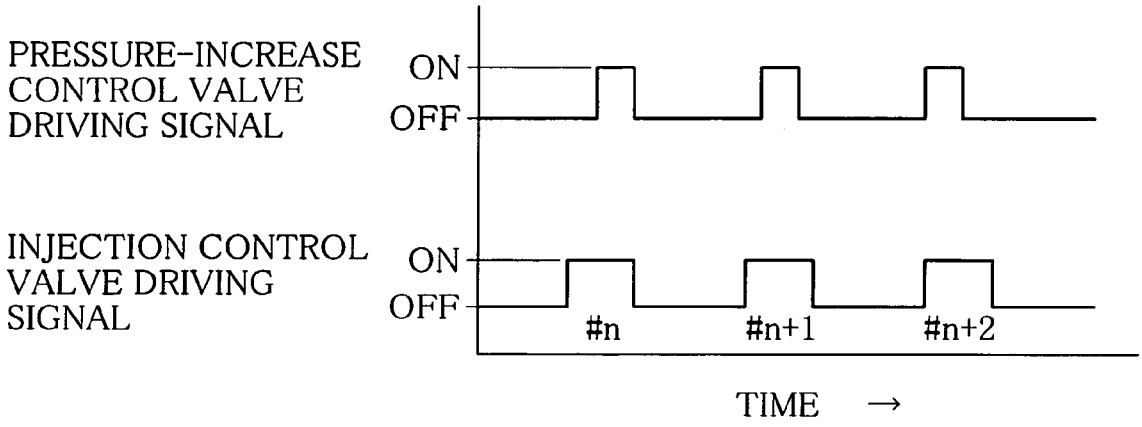
FIG. 11 is a time chart showing how fuel pressure is increased for fuel injection during the pressure-increase timing control.

FIG. 11 is a time chart showing how fuel pressure is increased for fuel injection during the pressure-increase timing control. It should be noted that how the pressure-increase timing control is carried out is identical with how the pressure-increase time period control in the third embodiment described above and illustrated in FIG. 9, and description thereof is therefore omitted.

In short, the pressure-increase timing control is to control the timing of pressure increase in place of the period of time for which fuel pressure is increased, which is controlled by the pressure-increase time period control described above. Specifically, when the pressure-increase flag is set due to a rapid increase in required load, the timing of opening of the pressure-increase control valve 58 of each cylinder is gradually changed at a predetermined rate of change from the retarded side to the advanced side as shown in FIG. 11 in the delay time period t5, and after the lapse of the delay time period t5, the timing of opening of the pressure-increase control valve 58 corresponds to the original timing of opening of the pressure-increase control valve 58 during increase of fuel pressure (pressure-increase timing control means). Conversely, when the pressure-increase flag is reset due to a rapid decrease in required load, the timing of opening of the pressure-increase control valve 58 is gradually changed at a predetermined rate of change from the advanced side to the retarded side, starting from the original timing of opening of the pressure-increase control valve 58, in the delay time period t6.

As described previously with reference to FIG. 2, the timing of opening of the pressure-increase control valve 58, i.e. the timing in which the pressure-increase mechanism 51 increases fuel pressure is a factor that determines the waveform of fuel injection pressure after pressure increase, and as indicated by chain lines in FIG. 2, the later the timing of pressure increase, the closer the injection pressure waveform is to an injection pressure waveform with initial injection suppressed, in other words, an injection pressure waveform in the case where fuel pressure is not increased. Therefore, immediately after the pressure-increase mechanism 51 is activated, the injection pressure waveform is gently changed from a shape in the case where fuel pressure is not increased to a shape in the case where fuel pressure has been increased as the timing of pressure increase is controlled to the advanced side, and immediately before the pressure-mechanism 51 is deactivated, the injection pressure waveform is gently changed from a shape after fuel pressure has been increased to a shape in the case where fuel pressure is not increased as the timing of pressure increase is controlled to the retarded side.

As described above, in the common rail fuel injection system according to the present embodiment, the timing of opening of the pressure-increase control valve 58 is controlled to the advanced side by carrying out the pressure-increase timing control when the pressure-increase mechanism 51 is activated, and on the other hand, the timing of opening of the pressure-increase control valve 58 is controlled to the retarded side by carrying out the pressure-increase timing control when the pressure-increase mechanism 51 is deactivated. As a result, the injection pressure waveform can be gently changed when the pressure-increase mechanism 51 is activated and deactivated. As is the case with fuel injection pressure in the third embodiment described above, an abrupt change in injection pressure waveform causes an abrupt change in the state of combustion. Preventing such a situation can prevent a driver from feeling something is wrong due to an abrupt change in combustion noise and suppress transitional increase in NOx and smoke caused by an abrupt change in the state of combustion.

In addition, the blank valve action control in the second embodiment described above becomes impossible to carry out when there is no room for setting the delay time periods t3 and t4 in a high-speed rotational range, but in such a case, the pressure-increase timing control in the present embodiment and the pressure-increase time period control in the third embodiment can be continuously carried out without problems.

Although the present invention has been described in some detail by way of illustration, it is to be understood that the present invention is not limited to the embodiments described above. For example, although in the above described embodiments, the common rail fuel injection system is applied to an engine for a vehicle, the present invention is not limited to this, but the common rail fuel injection system may be applied to a stationary engine.

Figure 12:
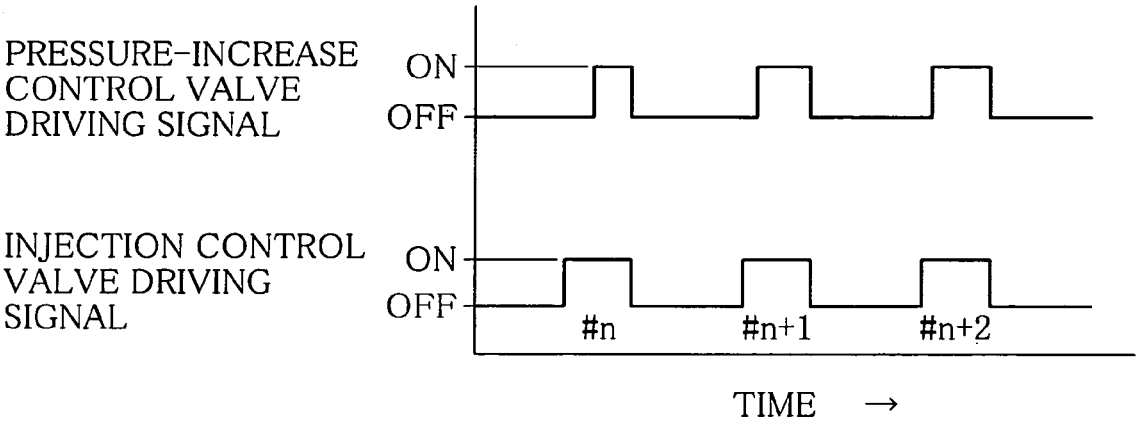
FIG. 12 is a time chart showing how fuel pressure is increased for fuel injection when the pressure-increase time period control and the pressure-increase timing control are carried out in combination.

Further, the pressure-increase delay control and the rail-pressure ramp control in the first embodiment, the blank valve action control in the second embodiment, the pressure-increase time period control in the third embodiment, and the pressure-increase timing control in the fourth embodiment should not necessarily be individually carried out, but may be carried out in arbitrary combination; for example, the pressure-increase time period control and the pressure-increase timing control may be carried out in combination. Specifically, as shown in FIG. 12, when the pressure-increase flag is set, the period of time for which the pressure-increase control valve 58 of each cylinder is gradually increased while the timing of opening of the pressure-increase control valve 58 is gradually changed from the retarded side to the advanced side, and when the pressure-increase flag is reset, the period of time for which the pressure-increase control valve 58 of each cylinder is gradually decreased while the timing of opening of the pressure-increase control valve 58 is gradually changed from the advanced side to the retarded side.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A common rail fuel injection system comprising:

a common rail that stores fuel pressurized by pressurizing pump;

fuel injection valves that inject the fuel stored in said common rail into respective cylinders of an engine; and a pressure-increase mechanism for introducing the fuel from said common rail to drive an increase-pressure piston and further pressurizing the fuel from said common rail so that fuel injection pressure can be arbitrarily increased, wherein said common rail fuel injection system further comprises control means for gradually changing a quantity of fuel discharged from the pressurizing pump when at least one of activation and deactivation of said pressure-increase mechanism is carried out.

2. A common rail fuel injection system according to claim 1, wherein:

a target rail pressure in said common rail is controllable; and said control means comprises:

rail-pressure ramp control means operable when the target rail pressure is changed with at least one of activation and deactivation of said pressure-increase mechanism, for continuously controlling the target rail pressure from a value before the change to a value after the change; and pressure-increase delay control means operable when said rail-pressure ramp control means starts changing the target rail pressure, for providing control to activate or deactivate said pressure-increase mechanism with a delay of a predetermined delay time period with respect to timing in which changing of the target rail pressure is required to be started.

3. A common rail fuel injection system according to claim 1, wherein said control means comprises blank valve action control means for carrying out blank valve action control in that a driving of the pressure-increase piston for a predetermined period of time is repeatedly carried out in timing that does not overlap timing of operation of said fuel injection valve immediately before the increase of the fuel pressure by said pressure-increase mechanism is started and/or immediately after the increase of the fuel pressure by said pressure-increase mechanism is stopped, said blank valve action control means providing control to gradually increase the period of time for which the pressure-increase piston is driven during the blank valve action control in a case where the blank valve action control is carried out immediately before the increase of the fuel pressure is started, and to gradually decrease the period of time for which the pressure-increase piston is driven during the blank valve action control in a case where the blank valve action control is carried out immediately after the increase of the fuel pressure is stopped.

4. A common rail fuel injection system according to claim 1, wherein said control means comprises pressure-increase time period control means for carrying out pressure-increase time period control in that the increase of the fuel pressure in a predetermined pressure-increase time period is repeatedly carried out immediately before the increase of the fuel pressure by the pressure-increase mechanism is started and/or immediately after the increase of the fuel pressure by said pressure-increase mechanism is stopped, said pressure-increase time period control means providing control to gradually increase the pressure-increase time period in a case where the pressure-increase time period control is carried out immediately before the increase of the fuel pressure is started, and to gradually decrease the pressure-increase time period in a case where the pressure-increase time period control is carried out immediately after the increase of the fuel pressure is stopped.

5. A common rail fuel injection system according to claim 1, wherein said control means comprises pressure-increase timing control means for carrying out pressure-increase timing control in that the increase of the fuel pressure in predetermined pressure-increase timing is repeatedly carried out by the pressure-increase piston immediately before the increase of the fuel pressure by the pressure-increase mechanism is started and/or immediately after the increase of the fuel pressure by said pressure-increase mechanism is stopped, said pressure-increase timing control means providing control to gradually advance the pressure-increase timing in a case where the pressure-increase timing control is carried out immediately before the increase of the fuel pressure is started, and to gradually retard the pressure-increase timing in a case where the pressure-increase timing control is carried out immediately after the increase of the fuel pressure is stopped.

* * * * *